United States Patent [19]

Licari

[11] Patent Number: 4,760,921

[45] Date of Patent: Aug. 2, 1988

[54] STACKABLE STORAGE RECEPTACLE AND MODULAR STORAGE SYSTEM MADE THEREFROM

[76] Inventor: Vito Licari, 875 Ocean Avenue, Elberon, N.J. 07740

[21] Appl. No.: 925,651

[22] Filed: Oct. 30, 1986

[51] Int. Cl.[4] ..... B65D 21/04

[52] U.S. Cl. ..... 206/504; 206/505; 206/509; 220/236; 220/23.4

[58] Field of Search ..... 206/504, 505, 509, 821; 220/4 A, 4 F, 23.6, 23.4

[56] References Cited

U.S. PATENT DOCUMENTS

| | | | |
|---|---|---|---|
| 3,672,530 | 6/1972 | Bridenstine | 220/4 A |
| 4,037,750 | 7/1977 | Box | 206/505 |
| 4,293,072 | 10/1981 | Hill | 206/821 |
| 4,473,155 | 9/1984 | Howitt | 206/505 |
| 4,509,930 | 4/1985 | Schweigert | 220/4 F |
| 4,619,363 | 10/1986 | Wolfseder | 220/23.6 |

*Primary Examiner*—George E. Lowrance
*Attorney, Agent, or Firm*—Ralph W. Selitto, Jr.

[57] ABSTRACT

A modular storage system is made from at least two stackable storage receptacles of one-piece molded plastic construction. Each receptacle has a plurality of T-shaped locking tabs formed integrally with the basket. Each tab is adapted to pivot from an as-molded position to a position in which it releaseably engages an overhead receptacle, as well as to a position in which it releaseably engages an adjacent receptacle.

12 Claims, 2 Drawing Sheets

STACKABLE STORAGE RECEPTACLE AND MODULAR STORAGE SYSTEM MADE THEREFROM

FIELD OF THE INVENTION

The present invention relates, in general, to a stackable storage receptacle which is provided with integral locking ties, and, more particularly, to a modular storage system constructed from a plurality of such receptacles.

BACKGROUND OF THE INVENTION

Modular storage systems are common. Typically, these systems include two or more storage baskets adapted to hold various articles. Generally, such storage baskets are made from wire mesh, plastic coated wire or injection molded plastic. The baskets may have open-meshed bottoms and sides or may have solid bottoms and sidewalls depending on their intended uses.

In the past, such baskets have been stacked, one on top of another, without the aid of a supporting frame. Typically, locating pins or projections on one basket cooperate with corresponding slots in the basket beneath it to correctly position the baskets with respect to one another. In such a configuration, the frictional fit of the projections in the mating slots is all that holds the baskets together. Obviously, the weight of the articles stored in a particular basket, as well as the weight of the basket itself, will hold the basket down onto the one beneath it. A serious drawback with this configuration is that the column of stacked baskets can not be slid, picked up or otherwise moved without the risk of the baskets separating from each other. Another drawback with this configuration is that it can become unsteady as more and more baskets are added to the column. Furthermore, should the column of unattached storage baskets accidently tip over, the baskets are likely to separate, thereby spilling their contents.

Separate locking devices may be provided to secure the individual baskets together. This addresses the drawbacks mentioned above, but introduces the possibility that the separate locking devices may be lost and also increases manufacturing costs as well as assembly time.

SUMMARY OF THE INVENTION

The problems and disadvantages of the prior art devices discussed above are overcome in accordance with the present invention by providing a plastic storage receptacle, such as a basket or crate, with monolithically formed attaching members adapted to releaseably attach the receptacle to another similar plastic storage receptacle when the receptacles are stacked one on top of the other or side by side. More particularly, each attaching member is pivotable between a first position in which it does not engage another receptacle, a second position in which it engages and overhead receptacle, and a third position in which it engages an adjacent receptacle.

In one embodiment, each attaching member is T-shaped and includes a stem, a crossbar extending generally transversely of the stem, a first live hinge located between the stem and an associated upper edge of the receptacle, and a second live hinge located between the first live hinge and the crossbar. By this construction, the attaching members can be bent such that the crossbars lie behind and bridge respective pairs of ribs on an adjacent or an overhead receptacle.

By stacking a plurality of receptacles one on top of the other and/or arranging them side by side, a modular storage system can be produced. Because the attaching members are formed monolithically with their corresponding receptacles, there is no need to provide separate fasteners. Also, the modular storage system can be assembled manually without the aid of tools.

BRIEF DESCRIPTION OF THE DRAWINGS

For a more complete understanding of the present invention, reference may be made to the following detailed description of an exemplary embodiment of the invention considered in conjunction with the accompanying drawings of same, in which.

DESCRIPTION OF THE EXEMPLARY EMBODIMENT

Figure 1:
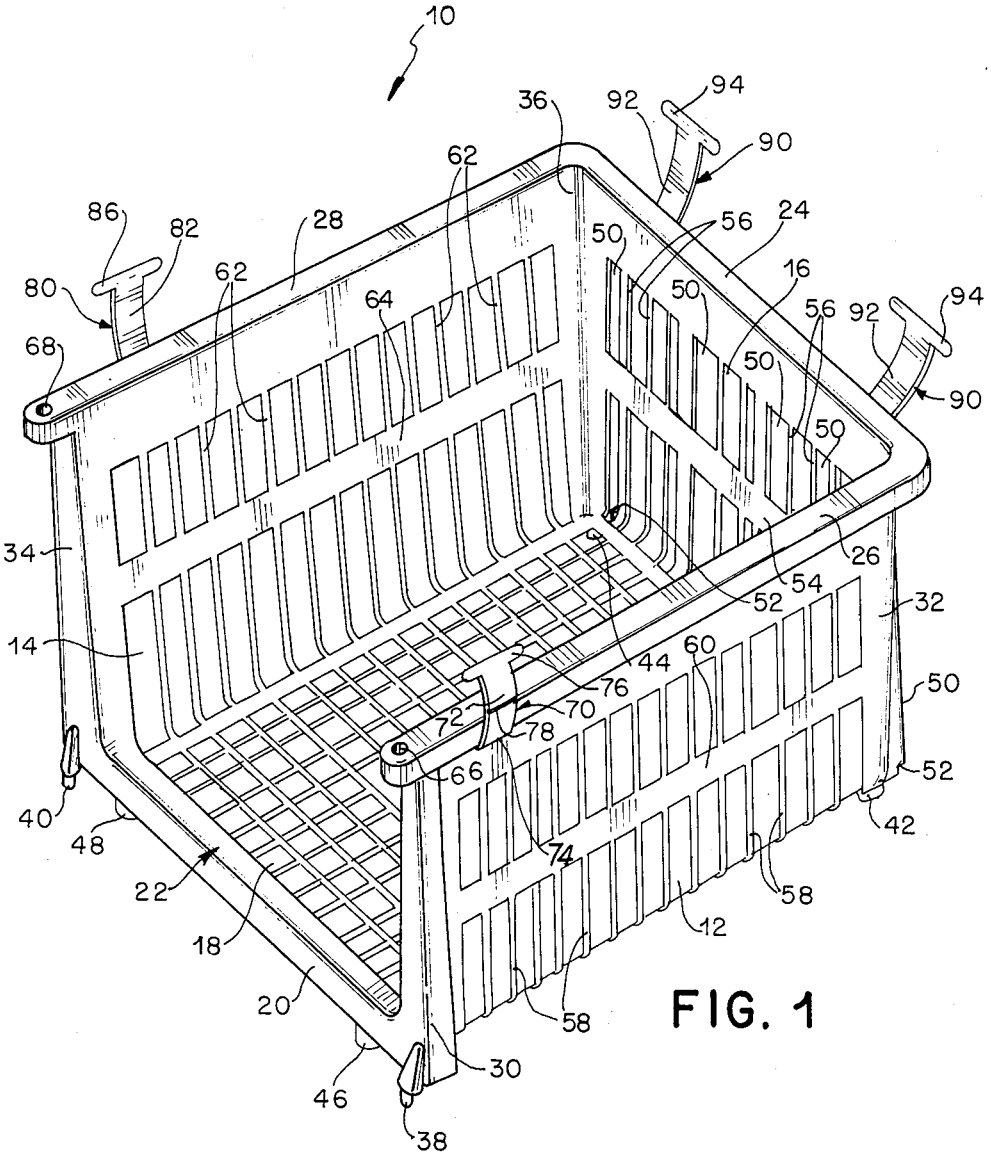
FIG. 1 is a front perspective view of a plastic storage basket constructed in accordance with one exemplary embodiment of the present invention, the basket including T-shaped attaching members which are illustrated in a bent position.
Figure 2:
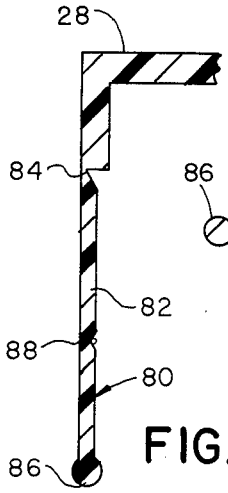
FIG. 2 is a detailed side view of one of the T-shaped attaching members illustrated in FIG. 1, the T-shaped attaching member being shown in its as-molded (i.e., unbent) position.
Figure 3:
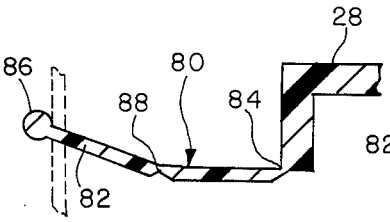
FIG. 3 is a detailed side view of the T-shaped attaching member of FIG. 2, the T-shaped attaching member being bent into a position in which it can be employed to attach its associated basket to an adjacent plastic storage basket a portion of the adjacent basket being shown in phantom.

With reference to FIGS. 1–5, a one-piece (i.e., monolithically) molded plastic storage basket 10 has sidewalls 12, 14, a rear wall 16, a bottom 18 and a generally U-shaped front wall 20, which defines an access opening 22. The front wall 20 provides the basket 10 with structural rigidity, as does an upper edge 24 of the rear wall 16 and upper edges 26, 28 of the sidewalls 12, 14, respectively.

The sidewall 12 forms a corner 30 with the front wall 20 and a corner 32 with the rear wall 16. Similarly, the sidewall 14 forms a corner 34 with the front wall 20 and a corner 36 with the rear wall 16.

Locating pins 38, 40 depend from the corners 30, 34, respectively. Feet 42, 44 depend from the corners 32, 36, respectively. The front wall 20 is also provided with depending feet 46, 48. The feet 42, 44, 46, 48 are adapted to receive swiveling wheels or rollers (not shown) in order to enhance the mobility of the plastic storage basket 10 or a modular storage system made therefrom.

The rear wall 16 has vertical struts 50, some of which are provided with notches 52 (see FIG. 5) for a purpose to be described hereinafter. A horizontal rib 54 extends across the rear wall 16, which is also provided with vertical ribs 56.

The sidewall 12 has vertical ribs 58 and a horizontal rib 60. Similarly, the sidewall 14 has vertical ribs 62 and a horizontal rib 64.

The upper edge 26 of the sidewall 12 is provided with a socket 66. Similarly, the upper edge 28 of the sidewall 14 is provided with a socket 68. The purpose of the sockets 66, 68 will be described hereinafter.

A T-shaped attaching member 70 depends from the upper edge 26 of the sidewall 12. More particularly, the T-shaped attaching member 70 includes a stem 72 which is pivotally attached to the upper edge 26 of the sidewall 12 by a live hinge 74. A crossbar 76 extends generally transversely of the stem 72. Another live hinge 78 is formed in the stem 72 between the live hinge 74 and the crossbar 76. The live hinges 74, 78 permit the T-shaped attaching member 70 to be bent from the position illustrated in FIG. 2 to the position illustrated in FIG. 3, as well as to the position illustrated in FIG. 4. The live hinge 78 can be eliminated provided the stem 72 has sufficient flexibility to be bent into the positions illustrated in FIGS. 3 and 4.

A T-shaped attaching member 80 depends from the upper edge 28 of the sidewall 14. More particularly, the T-shaped attaching member 80 includes a stem 82 which is pivotally attached to the upper edge 28 of the sidewall 14 by a live hinge 84 (see FIGS. 2–4). A crossbar 86 extends generally transversely of the stem 82. Another live hinge 88 (see FIGS. 2–4) is formed in the stem 82 between the live hinge 84 and the crossbar 86. The live hinges 84, 88 permit the T-shaped attaching member 80 to be bent in the same manner as the T-shaped attaching member 70.

T-shaped attaching members 90 depend from the upper edge 24 of the rear wall 16. More particularly, each of the T-shaped attaching members 90 includes a stem 92 which is pivotally attached to the upper edge 24 of the rear wall 16 by a live hinge (not shown). A crossbar 94 extends generally transversely of the stem 92. Another live hinge (not shown) is formed in the stem 92 between the crossbar 94 and the live hinge attached to the upper edge 24 of the rear wall 16. The live hinges function like the live hinges 74, 78 and the live hinges 84, 88 so as to permit the T-shaped attaching members 90 to be bent in the same manner as the T-shaped attaching members 70, 80.

The plastic storage basket 10 can be used as an individual stand-alone unit adapted to hold various articles, such as books, blankets, towels, clothes, toys, etc. Alternatively, the plastic storage basket 10 is adapted to have another similar or identical plastic storage basket stacked on top of it or arranged alongside it.

Figure 6:
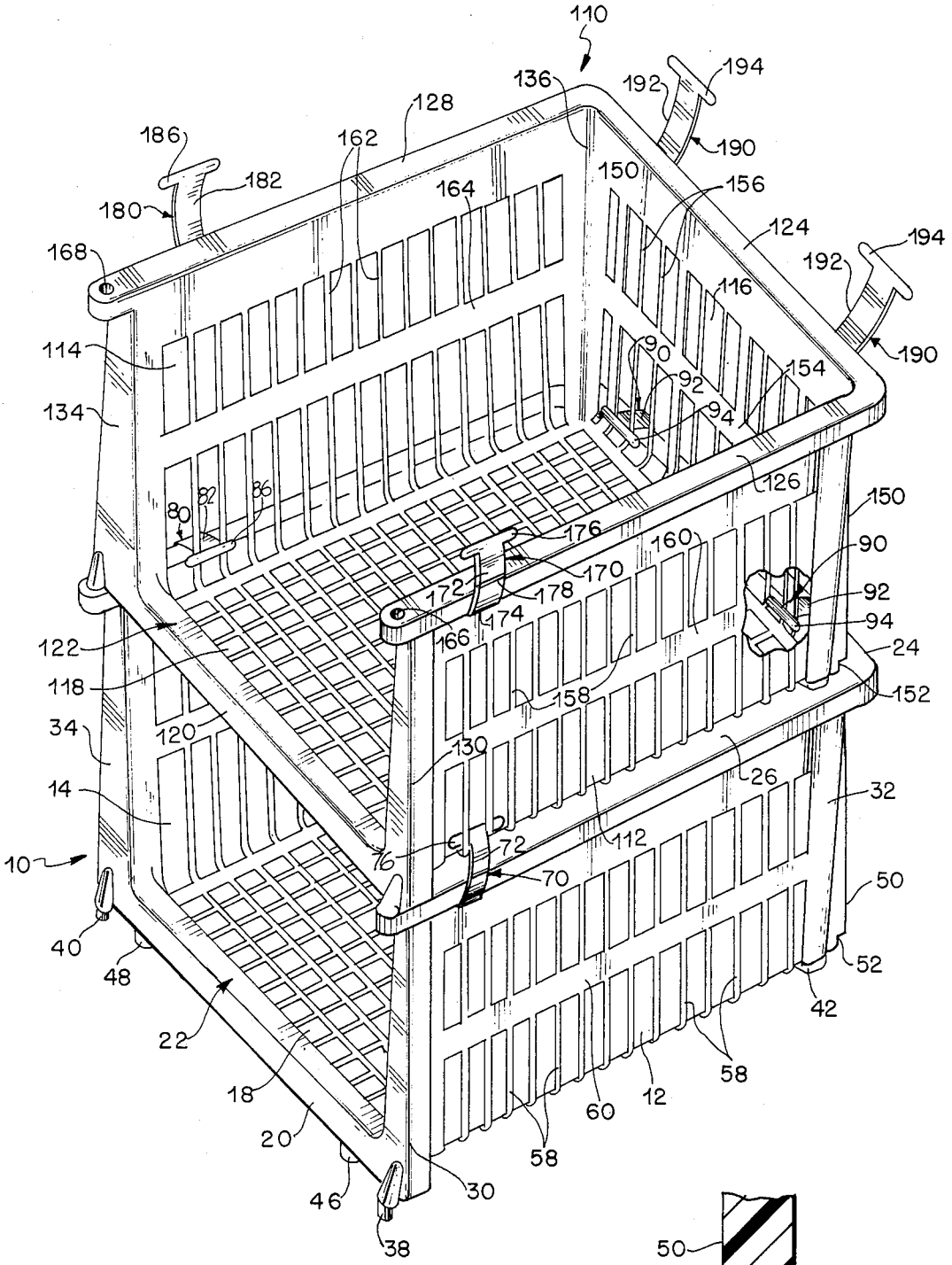
FIG. 6 is a perspective view of the plastic storage basket of FIG. 1 with another identical plastic storage basket stacked on top of it, a portion of the upper basket being broken away to facilitate consideration and discussion.
Figure 5:
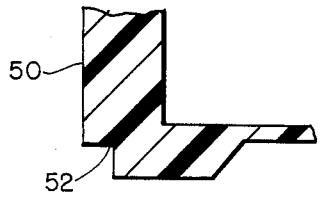
FIG. 5 is a partial cross-sectional view of a vertical strut formed as part of a rear wall of the plastic storage basket of FIG. 1.

With reference to FIG. 6, another identical plastic storage basket 110 is shown stacked on top of the plastic storage basket 10. To facilitate consideration and discussion, elements of the plastic storage basket 110 which correspond to elements described above with respect to FIGS. 1–5 have been designated by corresponding reference numerals increased by one hundred.

In order to stack the plastic storage basket 110 on top of the plastic storage basket 10, the plastic storage basket 110 is positioned such that vertical struts 150 rest on the upper edge 24 of the rear wall 16 of the plastic storage basket 10. Notches 152 facilitate the proper positioning of the plastic storage basket 110 such that locating pins (not shown) can be lowered into the sockets 66, 68 (see FIG. 1) of the plastic storage basket 10.

Figure 4:
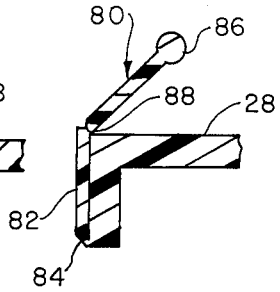
FIG. 4 is a detailed side view of the T-shaped attaching member of FIG. 2, the T-shaped attaching member being bent into a position in which it can be employed to attach together two plastic storage baskets stacked one on top of the other.

In order to inhibit the separation of the plastic storage baskets 10, 110, the T-shaped attaching member 70 is bent into the position shown in FIG. 4 and releaseably engaged behind and across an adjacent pair of vertical ribs 158 on sidewall 112 of the plastic storage basket 110. In a similar manner, the T-shaped attaching member 80 releaseably engages an adjacent pair of vertical ribs 162 on sidewall 114 of the plastic storage basket 110 and the T-shaped attaching members 90 releaseably engage corresponding pairs of vertical ribs 156 on rear wall 116 of the plastic storage basket 110.

The plastic storage baskets 10, 110 are sized and shaped such that they can be stacked one inside the other in a nested fashion. Such nesting of the plastic storage baskets 10, 110 facilitates their shipping, storage and display.

The manner of attaching the basket 10 to one or more similar or identical baskets arranged alongside the basket 10 is self evident. Briefly, either or both of the T-shaped attaching members 70, 80 would be engaged with ribs provided on the adjacent basket or baskets.

It will be understood that the embodiment described herein is merely exemplary and that a person skilled in the art may make many variations and modifications without departing from the spirit and scope of the invention. For instance, although the present invention has been described with reference to the plastic storage baskets 10, 110 in particular, the invention is applicable to any type of stackable storage receptacle, such as crates, boxes, etc. All such modifications and variations are intended to be included within the scope of the invention as defined in the appended claims.

I claim:

1. A plastic storage receptacle, comprising a body including opposed sidewalls, a rear wall, a bottom, a substantially open front and a substantially open top, said sidewalls and said rear wall each having a lower edge, an upper edge, a flange depending from said upper edge and an intermediate portion between said lower edge and said upper edge, said intermediate portion having a grid-like construction, wherein openings are provided therein; stacking means formed monolithically with said body for stacking said receptacle and another similar receptacle one on top of the other; and attaching means formed monolithically with said body for releaseably attaching said receptacle to said another similar receptacle when said receptacles are stacked one on top of the other, said attaching means including a plurality of T-shaped members, each T-shaped member being pivotable between a first position in which it is not engageable with said another similar receptacle, a second position in which it is engageable with said another similar receptacle through a corresponding one of the openings therein, and a third position in which it is engageable with yet another similar receptacle arranged alongside said receptacle, at least one of said T-shaped members being pivotally attached to said flange of one of said upper edges of said body and at least another of said T-shaped members being pivotally attached to said flange of another of said upper edges of said body, each T-shaped member including a stem, a cross-bar extending generally transversely of said stem, a first live hinge positioned between said stem and said flange of a corresponding one of said upper edges, and a second live hinge positioned between said first live hinge and said crossbar and each T-shaped member depending from said flange of a corresponding one of said upper edges when said T-shaped member is in its said first position, extending around and over said flange and said corresponding one of said upper edges when said T-shaped member is in its said second position, and extending generally laterally outwardly from said flange of said corresponding one of said upper edges when said T-shaped member is in its said third position.

2. The plastic storage receptacle of claim 1, wherein each sidewall includes a plurality of spaced-apart ribs extending from said lower edge of said sidewall to said upper edge of said sidewall and wherein said rear wall includes a plurality of spaced-apart ribs extending from said lower edge of said rear wall to said upper edge of said rear wall.

3. The plastic storage receptacle of claim 2, wherein at least one of said T-shaped members is attached to said flange of said upper edge of one of said sidewalls, at least one of said T-shaped members is attached to said flange of said upper edge of the other of said sidewalls, and at least one of said T-shaped members is attached to said flange of said upper edge of said rear wall.

4. The plastic storage receptacle of claim 1, wherein each T-shaped member lies behind and bridges a correspondidng pair of ribs of said another similar receptacle when said T-shaped member is in its said second position and lies behind and bridges a corresponding pair of ribs of said yet another similar receptacle when said T-shaped member is in its said third position.

5. The plastic storage receptacle of claim 4, wherein said stacking means includes male members depending from said bottom of said body and female members provided in at least some of said upper edges of said sidewalls and said rear wall of said body.

6. The plastic storage receptacle of claim 4, wherein said body is sized and shaped such that said receptacle is nestable in said another similar receptacle when said receptacles are not stacked one on top of the other.

7. A modular storage system made from a plurality of individual, substantially identical plastic receptacles stacked one on top of the other and/or side by side, each receptacle comprising a body including opposed sidewalls, a rear wall, a bottom, a substantially open front and a substantially open top, said sidewalls and said rear wall each having a lower edge, an upper edge, a flange depending from said upper edge and an intermediate portion between said lower edge and said upper edge, said intermediate portion having a grid-like construction, whereby openings are provided therein; stacking means formed monolithically with said body for stacking said receptacle and another similar receptacle one on top of the other; and attaching means formed monolithically with said body for releasably attaching said receptacle to said another receptacle when said receptacle and said another receptacle are stacked one on top of the other and for releaseably attaching said receptacle to yet another receptacle when said receptacle and said yet another receptacle are arranged alongside each other, said attaching means including a plurality of T-shaped members, each T-shaped member being pivotable between a first position in which it is not engageable with an overlaying or adjacent receptacle, a second position in which it is engageable with an overlaying receptacle through a corresponding one of the openings therein, and a third position in which it is engageable with an adjacent receptacle through a corresponding one of the openings therein, at least one of said T-shaped members being pivotally attached to said flange of one of said upper edges of said body and at least another of said T-shaped members being pivotally attached to said flange of another of said upper edges of said body, each T-shaped member including a stem, a crossbar extending generally transversely of said stem, a first live hinge positioned between said stem and said flange of a corresponding one of said upper edges, and a second live hinge positioned between said first live hinge and said crossbar and each T-shaped member depending from said flange of a corresponding one of said upper edges when said T-shaped member is in its said first position, extending around and over said flange and said corresponding one of said upper edges when said T-shaped member is in its said second position, and extending generally laterally outwardly from said flange of said corresponding one of said upper edges when said T-shaped member is in its said third position.

8. The modular storage system of claim 7, wherein each sidewall of each receptacle includes a plurality of spaced-apart ribs extending from said lower edge of said sidewall to said upper edge of said sidewall and wherein said rear wall of each receptacle includes a plurality of spaced-apart ribs extending from said lower edge of said rear wall to said upper edge of said rear wall.

9. The modular storage system of claim 8, wherein each receptacle includes at least one T-shaped member which is attached to said flange of said upper edge of one of said sidewalls of said receptacle, at least one T-shaped member which is attached to said flange of said upper edge of the other of said sidewalls of said receptacle, and at least one T-shaped member which is attached to said flange of said upper edge of said rear wall of said receptacle.

10. The modular storage system of claim 7, wherein each T-shaped member of each receptacle lies behind and bridges a corresponding pair of ribs of an overlaying receptacle when said T-shaped member is in its said second position and lies behind and bridges a corresponding pair of ribs of an adjacent receptacle when said T-shaped member is in its said third position.

11. The modular storage system of claim 10, wherein said stacking means of each receptacle includes male members depending from said bottom of said body of said receptacle and female members provided in at least some of said upper edges of said sidewalls and said rear wall of said body of said receptacle.

12. The modular storage system of claim 11, wherein said body of each receptacle is sized and shaped such that said receptacles are nestable one inside the other when said receptacles are not stacked one on top of the other and/or arranged side by side.

* * * * *